US005825386A

United States Patent [19]

Ohashi

[11] Patent Number: 5,825,386

[45] Date of Patent: Oct. 20, 1998

[54] PIEZOELECTRIC INK-JET DEVICE AND PROCESS FOR MANUFACTURING THE SAME

[75] Inventor: Yumiko Ohashi, Hashima, Japan

[73] Assignee: Brother Kogyo Kabushiki Kaisha, Nagoya, Japan

[21] Appl. No.: 609,990

[22] Filed: Feb. 29, 1996

[30] Foreign Application Priority Data

Mar. 9, 1995 [JP] Japan ..... 7-049547
Mar. 20, 1995 [JP] Japan ..... 7-060336

[51] Int. Cl.[6] ..... B41J 2/045

[52] U.S. Cl. ..... 347/71; 290/890.1

[58] Field of Search ..... 310/366, 367, 310/369, 358, 317; 347/68, 72, 71; 29/890.1

[56] References Cited

U.S. PATENT DOCUMENTS 4,284,996 8/1981 Greve ..... 347/68
4,395,719 7/1983 Majewski et al. ..... 347/68
5,239,224 8/1993 Kimura et al. ..... 310/366
5,650,806 7/1997 Denne ..... 347/20

FOREIGN PATENT DOCUMENTS

A-55-71572 5/1980 Japan .

*Primary Examiner*—Shawn Riley
*Attorney, Agent, or Firm*—Oliff & Berridge, PLC

[57] ABSTRACT

An ink-jet head has an actuator comprising conductive layers and piezoelectric ceramic layers which are alternately formed layer by layer in a cylindrical form so as to provide a hollow portion at the actuator center. The hollow portion corresponds to an ink chamber out of which ink is jetted. A process for manufacturing the ink-jet head is also disclosed.

18 Claims, 18 Drawing Sheets

PIEZOELECTRIC INK-JET DEVICE AND PROCESS FOR MANUFACTURING THE SAME

BACKGROUND OF THE INVENTION

1. Field of the Invention

This invention relates to an ink-jet device used in ink-jet printers or the like. More particularly it relates to an ink-jet device having ink chambers that feed ink from an ink feed source, actuators that change the volume of the ink chambers to cause the ink to jet out of them, and electrodes that are formed in the actuators and to which a voltage is applied from a power source circuit. This invention also relates to a process for manufacturing such an ink-jet device.

2. Description of the Related Art

As on-demand system printing heads used in ink-jet printers or the like, what are called thermal jet type printing heads and piezoelectric type printing heads are conventionally put into practical use, the former being heads that utilize a heat-generating device serving as an electrothermal transducer and the latter being heads that utilize a piezoelectric device serving as an elecltro-mechanical transducer. Compared with the printing heads that utilize heat-generating devices, the printing heads that utilize piezoelectric devices, as being not accompanied by the generation of heat, are advantageous in that they require less limitations on the liquids used as the substance to be jetted and also have a superior durability as printing heads.

The piezoelectric devices may have various forms. For example, as disclosed in Japanese Patent Application Laid-open No. 55-71572, an ink-jet head having an ink chamber formed in a cylindrical shape i s proposed. An outline of its make-up will be described below.

As shown in FIGS. 21 and 22, a multi-nozzle type ink-jet head is comprised of a housing 301, a number of cylindrical electrostrictive vibrators 302, a nozzle plate 303 and a printed electrode board 304.

The housing 301 is formed of a housing substrate 301*a* provided with a plurality of through-holes 307, and case boards 301*b* joined thereto. The space defined by these components forms a manifold. To this manifold 313, ink is fed from an ink feed source (not shown) through a pipe 305. To the printed electrode board 304, the housing substrate 301*a* is joined, and the printed electrode board 304 is provided with a plurality of registration holes 312 formed at the positions corresponding to the through-holes 307.

One end of each of the electrostrictive vibrators 302 is fitted into the respective registration holes 312 and at the same time joined to the housing substrate 301*a*. Spaces inside the electrostrictive vibrators 302 communicate with the manifold 313 through the throughholes 307. To the other ends of the electrostrictive vibrators 302, a nozzle plate 303 is joined in which nozzles 326 are formed.

An electrode 308 is formed in each of the electrostrictive vibrators 302 in the manner that the electrode 308 extends from the inside surfaces to both ends and outside surfaces of each of the vibrators 302, and electrodes 309 are formed on the outside surfaces of the electrostrictive vibrators 302. Over the entire surface of the electrodes 308, water-repellent Teflon coatings 310 are respectively formed. The electrodes 308 of the respective electrostrictive vibrators 302 are connected to a common earth wiring 311, and the electrodes 309 are respectively connected to divided electrodes 306 of the printed electrode board 304.

Mold sintering is usually used to produce the cylindrical electrostrictive vibrators 302.

Then, a drive voltage is applied to the electrodes 309 of the electrostrictive vibrators 302 respectively corresponding to ink-jetting nozzles 326 to cause the electrostrictive vibrators 302 to deform, so that the ink is jetted from the nozzles 326.

Since, however, the mold sintering is used to produce conventional cylindrical electrostrictive vibrators, it is difficult to make the thickness of each electrostrictive vibrator small enough to be deformable, where the thickness can be 30 to 40 $\mu$m at best. In addition, the drive voltage necessary for ink jetting must be increased in proportion to the thickness of the electrostrictive vibrator 302, and hence the electrostrictive vibrators 302 produced by such a conventional method have required a high drive voltage for the ink jetting. When such a high drive voltage is applied, the electric contact points between the divided electrodes 306 of the printed electrode board 304 and the electrostrictive vibrators 302 must be widely separated from other electric contact points in order to obtain sufficient dielectric strength. Thus, there has been the problem that it is difficult to make the ink-jet head smaller in size. Since also a high drive voltage must be applied, there has been another problem that the circuits are expensive.

In addition, since the plural electrostrictive vibrators 302 are individually produced as separate parts, it has been difficult and very troublesome to make registration of the respective electrostrictive vibrators 302.

SUMMARY OF THE INVENTION

The present invention invention was made in order to solve the problems discussed above.

A first object of the present invention is to provide an ink-jet device that may require only a low drive voltage and can be made small in size.

A second object of the present invention is to provide a manufacturing process which is suited for such an ink-jet device, and requires no registration of individual actuators.

To achieve the first object, the present invention provides an ink-jet device comprising at least one ink chamber that feeds ink from an ink feed source, at least one actuator that changes the volume of the ink chamber to cause the ink to jet out of the ink chamber, and a pair of electrodes that are formed in each actuator and to which a voltage is applied from a power source circuit.

In the present invention, each actuator comprises a plurality of piezoelectric ceramic layers and the electrodes. The plurality of piezoelectric ceramic layers and the electrodes are alternately formed layer by layer in a cylindrical form so as to provide a hollow portion at each actuator center. The hollow portion corresponds to the ink chamber.

To achieve the second object, the present invention provides a process for manufacturing an ink-jet device comprising at least one ink chamber that feeds ink from an ink feed source, and at least one actuator that changes the volume of the ink chamber to cause the ink to jet out of the ink chamber. This process comprises four steps.

The first step is to prepare a master having at least one cylindrical portion.

The second step is to bring at least the cylindrical portion of the master into contact with a sol-gel solution of a piezoelectric ceramic material to form a piezoelectric ceramic layer thereon.

The third step is to bring the cylindrical portion of the piezoelectric ceramic layer into an integral form.

The fourth step is to remove the master so as to provide a hollow portion at the part corresponding to the cylindrical portion of the master to form the ink chamber and at the same time produce the actuator, which comprises the piezoelectric ceramic layer.

DETAILED DESCRIPTION OF THE INVENTION

The ink-jet device of the present invention is basically comprised of at least one ink chamber that feeds ink from an ink feed source, at lease one actuator that changes the volume of each ink chamber to cause the ink to jet out of the ink chamber, and a pair of electrodes that are formed in each actuator and to which a voltage is applied from a power source circuit, and is characterized in that the electrodes and a plurality of piezoelectric ceramic layers are alternately superposingly formed in a cylindrical shape to provide a hollow portion at each actuator center, and the hollow portion corresponds to each ink chamber.

In the ink-jet device of the present invention, upon application of a voltage to the electrodes of the actuator, the multiple piezoelectric ceramic layers undergo deformation toward the hollow portion, so that the volume of the ink chamber is changed to cause the ink to jet out.

The process for manufacturing the ink-jet device of the present invention basically has the first step of preparing a master having at least one cylindrical portion; the second step of bringing at least the cylindrical portion of the master into contact with a sol-gel solution of a piezoelectric ceramic material to form a piezoelectric ceramic layer thereon; the third step of bringing the cylindrical portion of the piezoelectric ceramic layer into an integral form; and the fourth step of removing the master so as to provide a hollow portion at the part corresponding to the cylindrical portion of the master to form the ink chamber and at the same time produce the actuator, which actuator comprises the piezoelectric ceramic layer.

The ink-jet device, and process for manufacturing the ink-jet device, of the present invention will become apparent from the following description in the present specification.

A basic, first embodiment of the present invention which embodies the ink-jet device of the present invention will be described below in detail with reference to the accompanying drawings.

Figure 1:
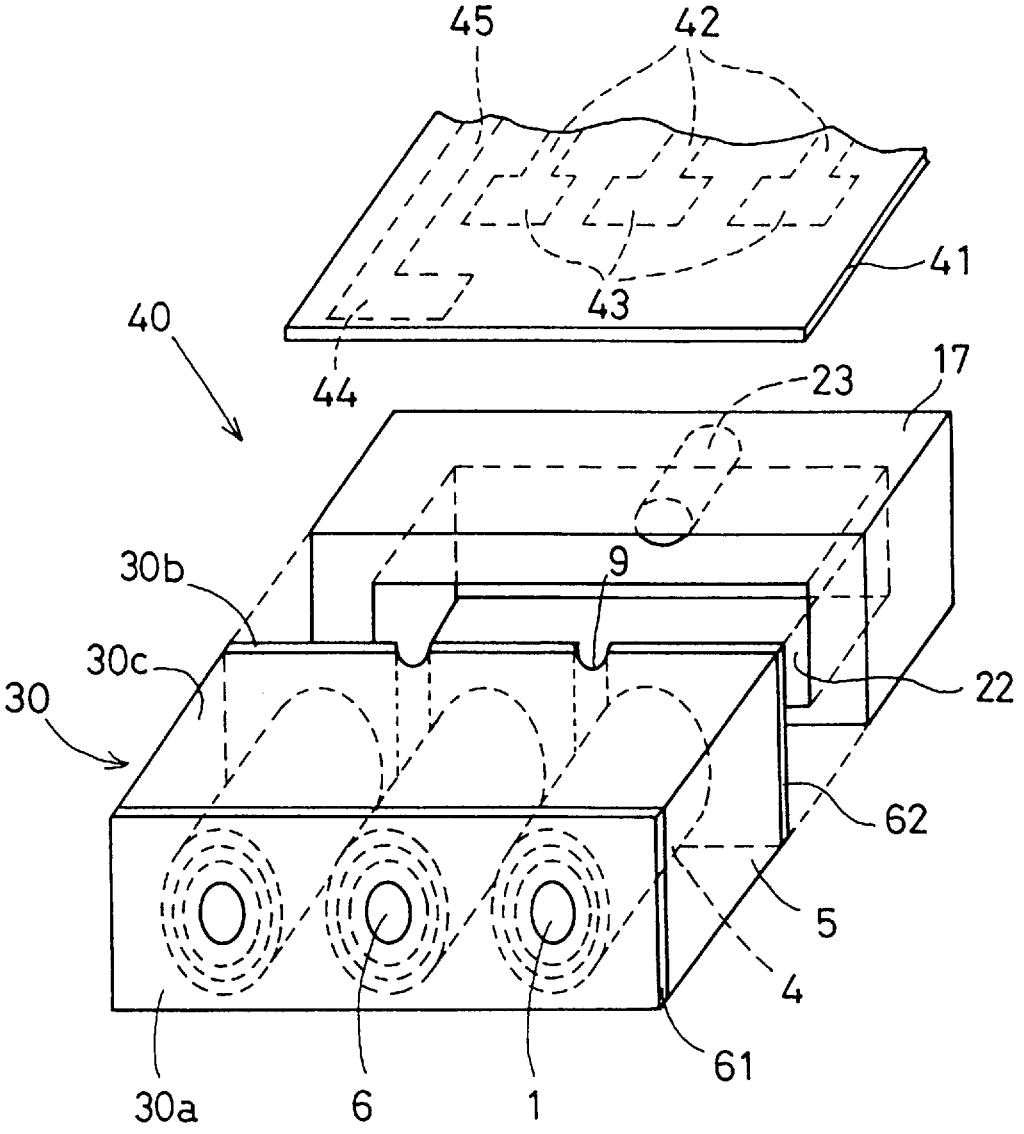
FIG. 1 is a perspective view to illustrate an ink-jet head according to a first embodiment of the present invention.

FIG. 1 perspectively illustrates the structure of an ink-jet head. An ink-jet head 40 is constituted of an actuator member 30, a manifold member 17 and a flexible printed board 41. The actuator member 30 is comprised of a plurality of hollow cylindrical actuators 4 and a holder 5 made of a resin, that holds the actuators 4. The holder 5 may be made of, e.g., an epoxy resin with a Rockwell hardness of M-85. So long as the resin used in the holder 5 has a Rockwell hardness of from M-60 to M-130, the ink can be well jetted out of each actuator 4.

Figure 2:
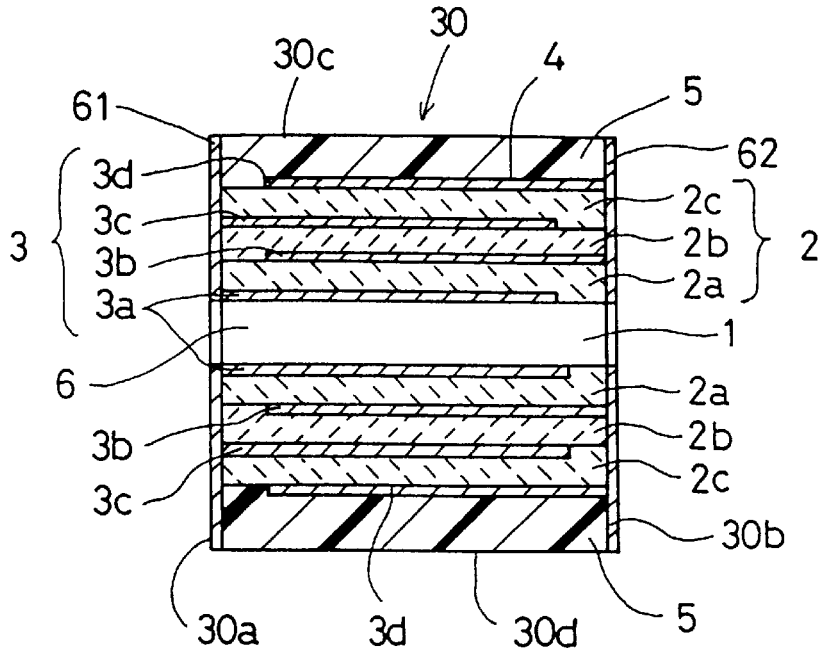
FIG. 2 is a cross-sectional view of an actuator member in the first embodiment.

As shown in FIG. 2, the actuator 4 is formed of conductive layers 3 and piezoelectric ceramic layers 2 which are alternately superposingly formed in plurality. In the first embodiment, the conductive layers 3 are superposed in four layers, and the piezoelectric ceramic layers are superposed in three layers. A conductive layer 3*a* is formed on the inner surface of a hollow cylindrical piezoelectric ceramic layer 2*a*, and a conductive layer 3*b* is formed on the outer surface thereof. A piezoelectric ceramic layer 2*b* is formed on the outer surface of the conductive layer 3*b*, and a conductive layer 3*c* is formed on the outer surface of the piezoelectric ceramic layer 2*b*. A piezoelectric ceramic layer 2*c* is formed on the outer surface of the conductive layer 3*c*, and a conductive layer 3*d* is formed on the outer surface of the piezoelectric ceramic layer 2*c*. The conductive layers 3*a* and 3*c* are laid bare on the side of an end face 30*a* of the actuator member 30, and are not laid bare on the side of another end face 30*b* thereof. The conductive layers 3*b* and 3*d* are laid bare on the side of the end face 30*b*, and are not laid bare on the side of the end face 30*a*.

Thus, the conductive layers 3*a* and 3*c* are connected to a metal electrode 61 formed on the end face 30*a* of the actuator member 30, and the conductive layers 3*b* and 3*d* are connected to a metal electrode 62 formed on the end face 30*b*. The metal electrode 61 is connected in common to the conductive layers 3*a* and 3*c* of all the actuators 4, and each metal electrode 62 is separated by grooves 9. Hence, each metal electrode 62 is formed correspondingly to each actuator and is connected to the conductive layers 3*b* and 3*d* of each actuator 4.

Figure 4:
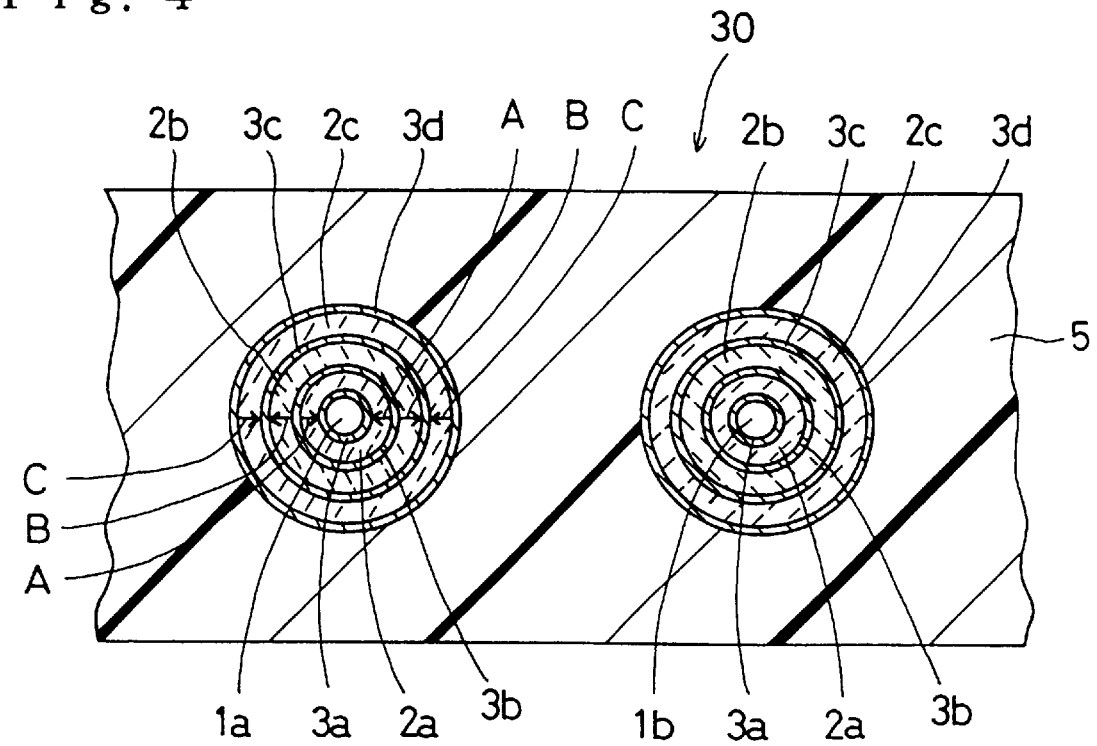
FIG. 4 is a cross-sectional view to illustrate the ink-jet head of the first embodiment.

As shown in FIG. 4, the piezoelectric ceramic layer 2*a* is polarized in the direction of an arrow A which is the direction of from the conductive layer 3*b* to the conductive layer 3*a*, the piezoelectric ceramic layer 2*b* is polarized in the direction of an arrow B which is the direction of from the conductive layer 3*b* to the conductive layer 3*c*, and the piezoelectric ceramic layer 2*c* is polarized in the direction of an arrow C which is the direction of from the conductive layer 3*d* to the conductive layer 3*c*.

Then, as shown in FIG. 2, the hollow portion of the cylindrical actuator 4 forms an ink chamber 1 to be filled with ink, and opens to the opposing end faces 30*a* and 30*b* of the actuator member 30. The opening on the side of the end face 30*a* forms a nozzle 6 out of which the ink is jetted.

As shown in FIG. 1, the manifold member 17 is formed of a manifold 22 communicating with all the ink chambers 1 and an ink feed inlet 23 communicating with an ink tank (not shown), and the open side of the manifold 22 are bonded to the end face 30*b* of the actuator member 30. The manifold 22 has a size large enough to cover the openings of all the actuators 4.

The flexible printed board 41 is bonded to the surface 30*c* of the actuator member 30 (the upper surface as viewed in FIG. 1). Alternatively, it may be bonded to the surface on the side opposite to the surface 30*c*. On the flexible printed board 41, contact point electrodes 43 and 44 are formed. The contact point electrode 44 is provided correspondingly to the metal electrode 61, and the contact point electrode 43 is provided correspondingly to each metal electrode 62. Each contact point electrode 43 is connected to each conductive line 42, and the contact point electrode 44 is connected to a conductive line 45.

Figure 3:
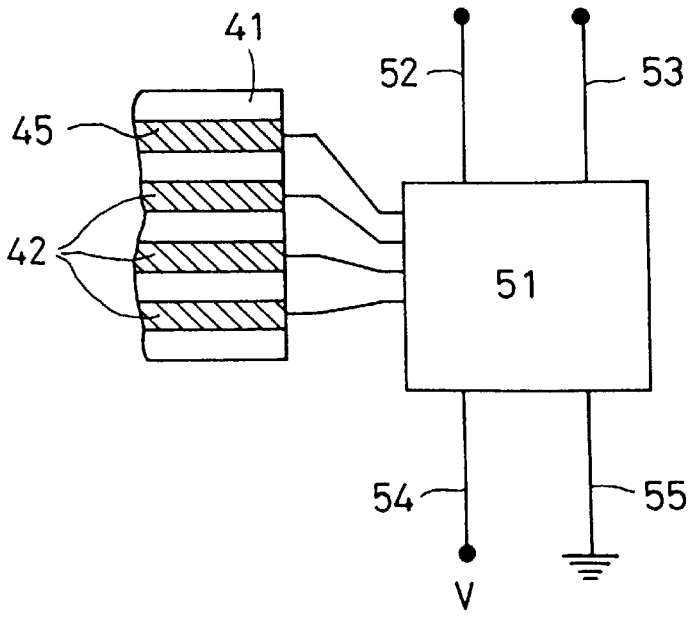
FIG. 3 is a block diagram to illustrate a control section in the first embodiment.

The respective conductive lines 42 and 45 are connected, as shown in FIG. 3, to an LSI chip 51. A clock line 52, a data line 53, a voltage line 54 and an earth line 55 are also connected to the LSI chip 51. The LSI chip 51 judges which nozzle 6 should jet out ink droplets first, judging from the data coming to pass on the data line 53 and in accordance with continuous clock pulses fed from the clock line 52, and applies a voltage V of the voltage line 54 to the conductive lines 42 electrically conducting to the metal electrode 62. The conductive line 42 electrically conducting to the metal electrode 62 other than that of the ink chamber 1 to be driven and the conductive line 45 electrically conducting to the metal electrode 61 are connected to the earth line 55.

How the ink-jet head 40 is driven will be described below.

Figure 5:
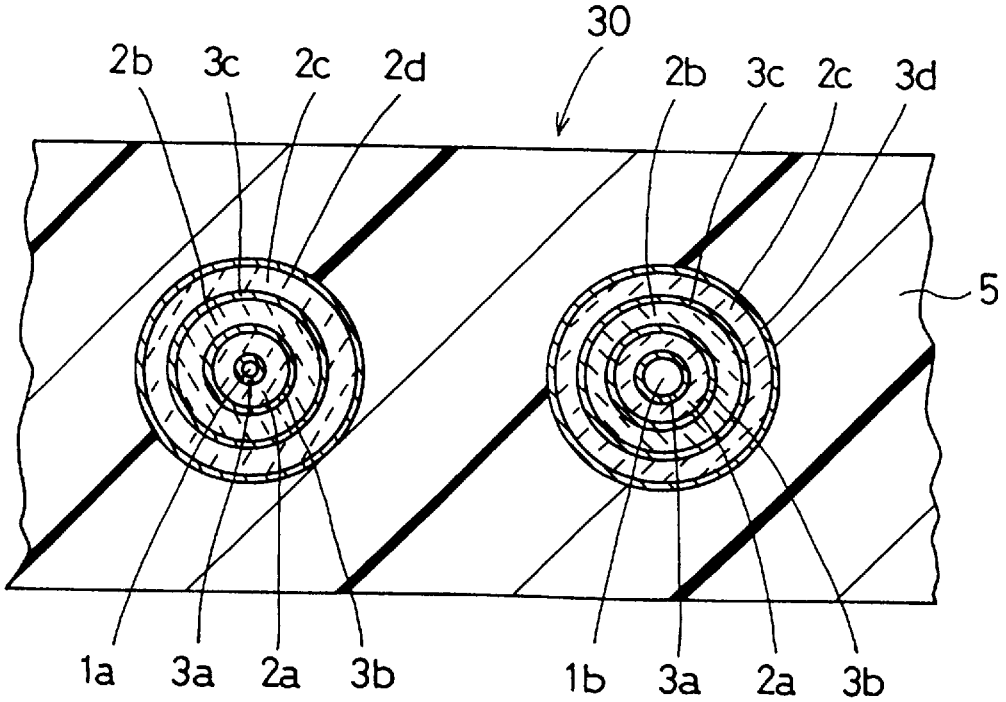
FIG. 5 illustrates how the ink-jet head of the first embodiment operates.

Once the LSI chip 51 has judged that the ink be jetted out of the ink chamber 1*a* shown in FIG. 5, the LSI chip 51 connects the voltage line 54 to the conductive lines 42 electrically connected to the metal electrodes 62 of the ink chamber 1*a*, and connects to the earth line 55 the conductive line 415 electrically connected to the metal electrodes 61 common to all the ink chambers 1. As a result, an electric field in the direction of from the conductive layer 3*b* to the conductive layer 3*a* is generated in the piezoelectric ceramic layer 2*a* of the actuator 4 of the ink chamber 1*a*, an electric field in the direction of from the conductive layer 3*b* to the conductive layer 3*c* is generated in the piezoelectric ceramic layer 2*b*, and an electric field in the direction of from the conductive layer 3*d* to the conductive layer 3*c* is generated in the piezoelectric ceramic layer 2*c*. That is, electric fields in the same directions as the polarization directions A, B and C are generated in the piezoelectric ceramic layers 2*a*, 2*b* and 2*c*, respectively, of the ink chamber 1*a*.

Then, since the piezoelectric ceramic layers 2*a*, 2*b* and 2*c* of the actuator 4 of the ink chamber 1*a* have electric fields in the same directions as the polarization directions A, B and C, the piezoelectric ceramic layers 2*a*, 2*b* and 2*c* deform toward the inside of the ink chamber 1*a* as shown in FIG. 5 to decrease the volume of the ink chamber 1*a*. As a result, a pressure is applied to the ink inside the ink chamber 1*a*, so that the ink is jetted out of the nozzle 6. Thereafter, the metal electrode 62 of the ink chamber 1*a* is connected to the earth line 55 so that the ink chamber 1*a* undergoes an increase in its volume to return to the state where it naturally stands (the state shown in FIG. 4) from the previous state where its volume has decreased. Thus, the ink is afresh fed from the manifold 22 to the ink chamber 1*a*.

Alternatively, the directions of polarization of the piezoelectric ceramic layers 2*a*, 2*b* and 2*c* may be made opposite to the directions of the generated electric fields so that the ink chamber 1*a* undergoes an increase in volume to receive the feed of ink, where the application of the drive voltage is then stopped to cause the ink chamber 1*a* to undergo a decrease in volume to return to the natural state so that ink droplets are jetted out of the ink chamber 1*a*.

In this way, since in the ink-jet head according to the present embodiment the piezoelectric ceramic layers 2 are formed in multi-layers, the actuator 4 can be highly rigid. Hence, the drive voltage necessary for jetting the ink out of the ink chamber 1*a* can be set at a low value. Accordingly, the distance between the metal electrodes 62 connected to the contact point electrodes 43 of the flexible printed board 41 can be made shorter than ever. Thus, the ink-jet head 40 can be made smaller in size and the degree of integration of nozzles can be enhanced. Also, the drive circuits can be prepared at a low cost.

In addition, since all the actuators 4 are integrally held by the holder 5 made of resin , it is unnecessary to make registration of the respective actuators 4.

Moreover, since the flexible printed board 41 connected to the LSI chip 51 and the metal electrodes 61 and 62 are connected on the upper surface 30*c* of the actuator member 30, they can be connected with ease.

Furthermore, since the openings on the side of the end face 30*a* of the actuator 4 serve as nozzles 6, it is unnecessary to provide any nozzle plate having nozzles formed therein, which has been conventionally necessary. Hence, any devices and steps therefor are unnecessary, so that the production cost can be reduced.

Still furthermore, since the conductive layer 3*a* laid bare to the inside of the ink chamber 1 is always earthed, it is unnecessary to provide any insulating layer for electrically insulating the ink from the conductive layer 1*a*. Hence, any devices and steps therefor are unnecessary, so that the production cost can be reduced.

In the ink-jet device according to the first embodiment, the power source circuit is constituted of the LSI chip 51, the clock line 52, the data line 53, the voltage line 54, the earth line 55 and so forth. A first electrode is comprised of the conductive layers 3*a* and 3*c*, and a second electrode is comprised of the conductive layers 3*b* and 3*d*. The common electrode is assigned to the metal electrode 61, and the drive electrode to the metal electrode 62.

A protective layer may also be formed on the inner surface of the ink chamber so that the conductive layer 3*a* does not come into direct contact with the ink. This enables prevention of the conductive layer 3*a* from its corrosion due to the ink. When it is formed , a piezoelectric ceramic thin layer may be used as the protective layer.

A process for manufacturing the ink-jet head 40 that characterizes the ink-jet device according to the first embodiment will be described below.

Figure 6:
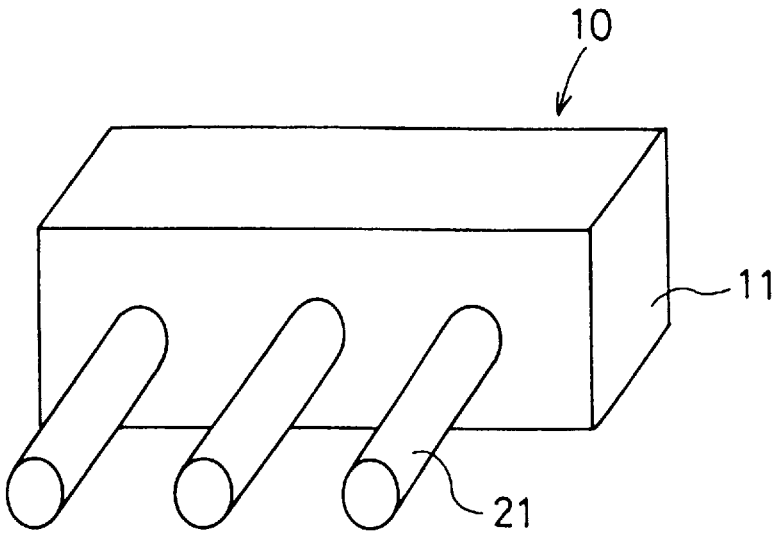
FIG. 6 is a perspective view to illustrate a master used to prepare the actuator member of the first embodiment.

As the first step, a master 10 is prepared which is, as shown in FIG. 6, provided with a plurality of cylinders 21 in a given size, upright arranged at given intervals on a conductive substrate 11 made of nickel. The cylinders 21 corresponds to the ink chambers 1. For example, the cylinders 21 are arranged in a row at 300 μm pitch, and in the number of 62 columns, each having a cylinder diameter of 40 μm and a height of 1 mm. In FIG. 6, only three cylinders 21 are illustrated.

Figure 7:
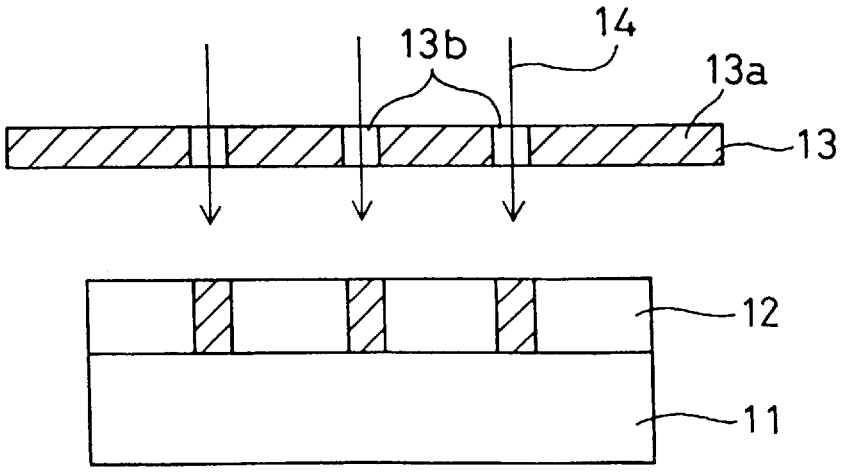
FIG. 7 illustrates a step to prepare the master used in the first embodiment.

To prepare this master 10, the LIGA process (cf., e.g., E. W. Becker et al., Microelectronic Eng., 4, 35(1986)) widely used in the fabrication of micro-machines may be used. Stated specifically, as shown in FIG. 7, an X-ray resist 12 of 1 mm thick or larger is formed on the conductive substrate 11 made of nickel. This X-ray resist 12 is formed by coating several times a positive resist solution having good sensitivity and resolution until it has a given thickness. Alternatively, though the resolution is a little lower, a film-like resist may be formed by hot contact bonding or the like.

Subsequently, a mask 13 is brought into contact with the conductive substrate 11 on which the positive resist 12 has been formed. In FIG. 7, to make it easy to understand, the mask 13 and the conductive substrate 11 are illustrated in a separated form. Here, when X-ray exposure is applied, the resist 12 and the mask 13 are not required to be in so much close contact. The mask 13 is comprised of non-transmissive areas 13*a* that do not transmit X-rays, and given pattern areas 13*b* through which X-rays are transmissive. The pattern areas 13*b* each have the form of a circle of 40 μm diameter and 62 circles are arranged in a row (only three circles are illustrated in the drawing). Then, synchrotron radiation light (X-rays) 14 is(are) made incident on the resist 12 via the mask 13. Only the portions corresponding to the pattern area 13*b* of the resist 12 (the portions shaded in the drawing) are exposed to the synchrotron radiation light.

Next, upon development using an alkali type developer, the portions exposed to the X-rays 14 are dissolved in the developer and removed. That is, cylindrical holes of 40 μm diameter, having a height corresponding to the layer thickness of the resist 12 are formed. Thus, cylindrical holes as deep as 1 mm or more can be formed in the resist in a high aspect ratio. This high aspect ratio generally requires the use of the synchrotron X-ray exposure. Using as a mold the resist 12 in which the cylindrical holes have been formed, for example, nickel is deposited by electrolytic plating in a thickness of about 1 mm at the portions corresponding to the cylindrical holes of the resist 12 formed on the conductive substrate 11. Then, the resist 12 is removed with an organic solvent or the like, whereupon the master 10 provided with a plurality of cylinders 21 formed of nickel, upright arranged on the conductive substrate 11, is obtained.

Figure 8A:
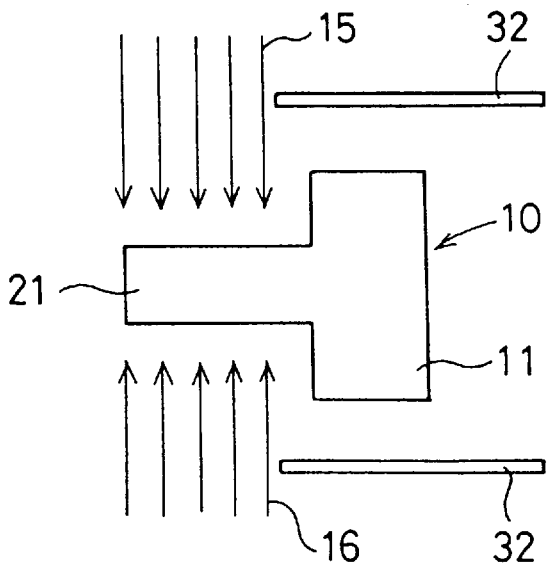
FIGS. 8A and 8B illustrate steps to form a conductive layer of the actuator member in the first embodiment.
Figure 9A:
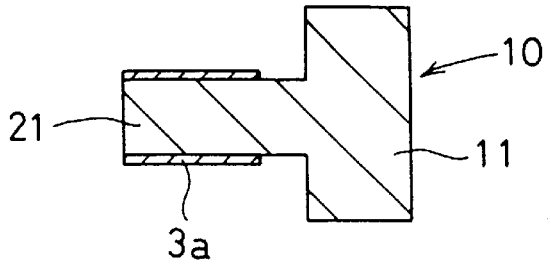
FIGS. 9A to 9D illustrate steps through which conductive layers and piezoelectric ceramic layers are superposingly formed in the first embodiment.

How to prepare the actuator member 30 will be described subsequently. First, a conductive layer 3*a* of 1 μm thick made of titanium is formed on each cylinder 21 of the master 10. This layer is formed in the following way. As shown in FIG. 8A, a masking shield 32 is set to cover the portions corresponding to the base of the cylinder 21 and the conductive substrate 11, and vacuum deposition is carried out from two directions (arrows 15 and 16) to form the conductive layer 3*a* on the cylinder 21 as shown in FIG. 9A. Since the vacuum deposition is a well known process, detailed description is omitted here. Stated briefly, it is a process of depositing atoms and molecules flying from a deposition source, where they travel in a straight line. Hence, the deposition may be shielded in that direction, whereby the film forming area can be defined relatively with ease.

Figure 9B:
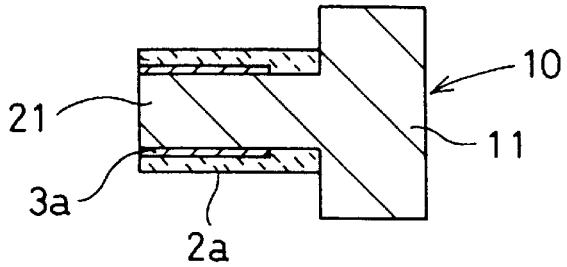

Next, as the second step, the piezoelectric ceramic layer 2*a* is formed on the cylinder 21 so as to cover the conductive layer 3*a*. Stated specifically, first the master 10 with the conductive layer 3*a* is dipped in a bath of a sol-gel solution of 4% lead zirconate titanate (PZT, trade name of piezoelectric ceramic; available from High Purity Chemicals Co., Ltd.) (this step is herein called the step of dipping). Here, at least the whole cylinder 21 is dipped into the sol-gel solution. Next, the cylinder 21 dipped is drawn up at a speed of 2 mm per minute. The cylinder 21 thus drawn up is then calcined at 150° C. for 10 minutes in a clean environment. After such steps, only a piezoelectric ceramic layer with a layer thickness of about 0.3 μm can be formed , and hence the step of dipping, the step of drawing up and the step of calcination are repeated until the layer thickness comes to be about 15 μm. As the result, as shown in FIG. 9B, the piezoelectric ceramic layer 2*a* is formed on the the cylinder 21 to cover the conductive layer 3*a*. The sol-gel solution may react with moisture in the air, and hence the whole bath must be closed.

Before the conductive layer 3*a* is formed, a very thin piezoelectric ceramic layer may be formed as a protective layer of the conductive layer 3*a*, using the sol-gel solution. This enables prevention of the conductive layer 3*a* from its corrosion due to the ink.

Figure 8B:
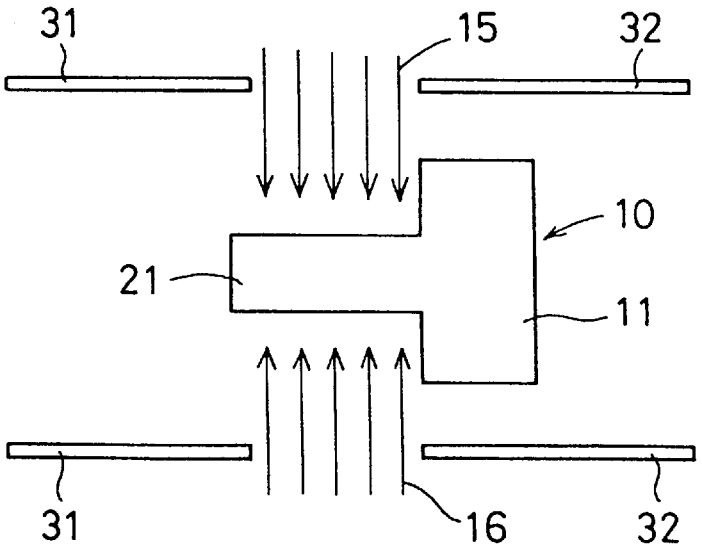
Figure 9C:
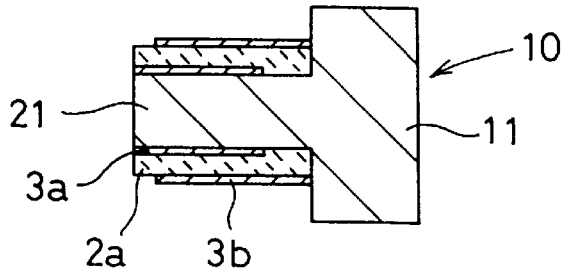

Next, as shown in FIG. 9C, a conductive layer 3*b* of 1 μm thick made of titanium is formed on the piezoelectric ceramic layer 2*a*. This layer is formed in the following way. As shown in FIG. 8B, masking shields 31 and 32 are set to cover the portions corresponding to the top of the cylinder 21 and the conductive substrate 11, and vacuum deposition is carried out from two directions (arrows 15 and 16) to form the conductive layer 3*b*.

Figure 9D:
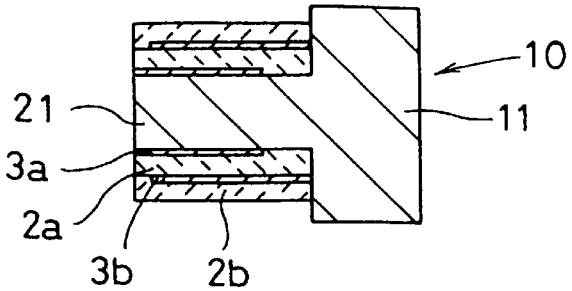

Next, as shown in FIG. 9D, the piezoelectric ceramic layer 2*b* is formed in the same manner as the piezoelectric ceramic layer 2*a*. Subsequently, a conductive layer 3*c* of 1 μm thick made of titanium is formed on the piezoelectric ceramic layer 2*b* in the same manner as the conductive layer 3*a*, and the piezoelectric ceramic layer 2*c* is further formed thereon in the same manner as the piezoelectric ceramic layer 2*a*. Next, on the piezoelectric ceramic layer 2*c*, a conductive layer 3*d* of 1 μm thick made of titanium is formed in the same manner as the conductive layer 3*b*.

Figure 10:
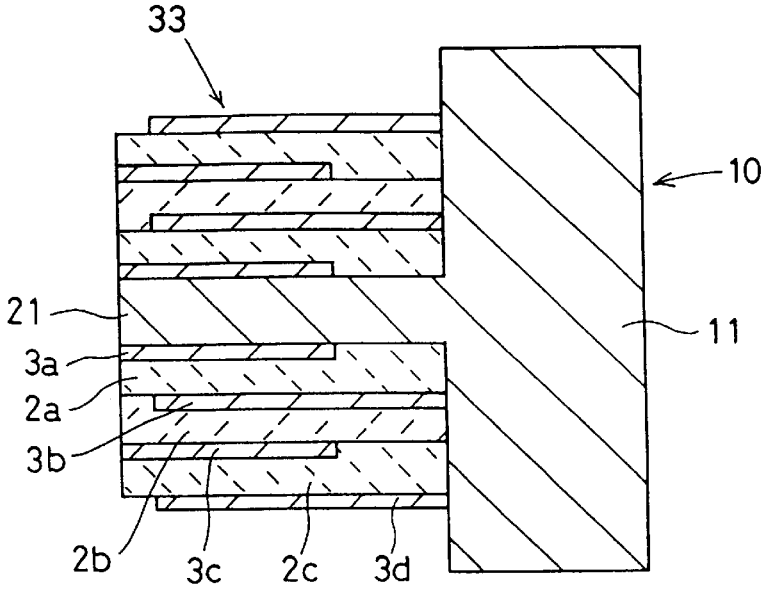
FIG. 10 is a cross-sectional view to illustrate a PZT structure in the first embodiment.

The master 10 on which the conductive layers 3*a*, 3*b*, 3*c* and 3*d* and the piezoelectric ceramic layers 2*a*, 2*b* and 2*c* have been formed in this way is fired at about 600° C., for about 30 minutes to form the piezoelectric ceramic layers 2, having good piezoelectric properties. Thus, a PZT structure 33 (FIG. 10) having a multi-layered cylinder is prepared.

Figure 11:
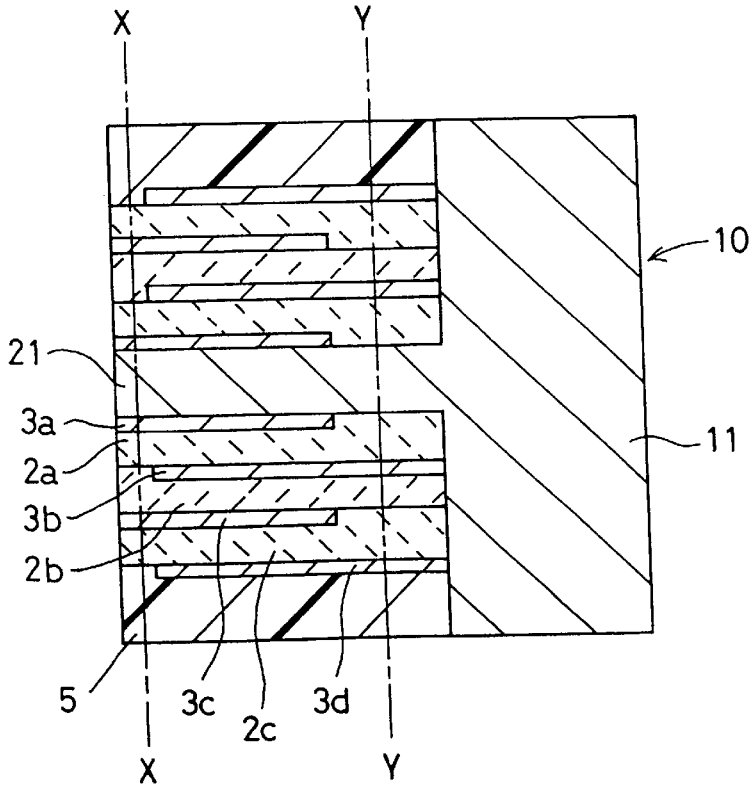
FIG. 11 illustrates a step to produce the actuator member in the first embodiment.

Next, as the third step, a plurality of multi-layered cylinders are covered with a resin of an epoxy type or the like to integrally form the PZT structure into a block (FIG. 11). The resin serves as the holder 5. Then, the cylinder 21 is cut on the side of its top along the line X—X. The cylinder 21 is also cut on the side of its base along the line Y—Y. The conductive layers 3*a* and 3*b* are laid bare to the X—X line cut surface, and the conductive layers 3*b* and 3*d* are laid bare to the Y—Y line cut surface.

Figure 12:
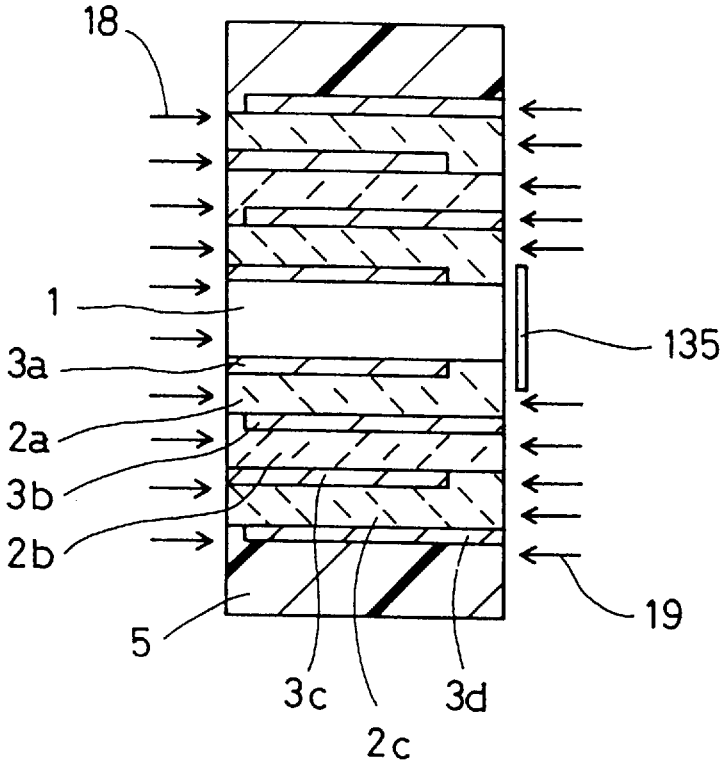
FIG. 12 illustrates a step to form metal electrodes at end faces of the actuator member in the first embodiment.

Next, as the fourth step, the master 10 made of nickel is dissolved away by wet etching with a ferric chloride solution. As a result, the part corresponding to each cylinder 21 becomes hollow. Then, as shown in FIG. 12, a chromium-nickel double-layer film is first formed on the whole end face to which the conductive layers 3*a* and 3*c* are laid bare, the film being formed by vacuum deposition applied from the side of arrows 18. Next, another chromium-nickel double-layer film is formed on the whole end face to which the conductive layers 3*b* and 3*d* are laid bare, the film being formed by vacuum deposition applied from the side of arrows 19. Here, in order to prevent a short between i) the conductive layer 3*a* and the chromium-nickel double-layer film formed on the side to which the conductive layer 3*a* is laid bare and ii) the chromium-nickel double-layer film subsequently formed on the side to which the conductive layer 3*b* is laid bare, a masking shield 135 which is slightly larger than the diameter of the ink chamber 1 and slightly smaller than the diameter of a circle formed by the conductive layer 3*b* (the distance between the upper conductive layer 3*b* and the lower conductive layer 3*b* as cross-sectionally viewed in FIG. 12) is provided in the positional relation as shown in FIG. 12, to carry out the vacuum deposition from the side of arrows 18. Thus, the double-layer film formed on the side to which the conductive layer 3*b* is laid bare can be prevented from extending into the ink chamber 1. Thereafter, the double-layer film on the side to which the conductive layers 3*b* and 3*d* are laid bare is mechanically divided by means of a diamond blade to form the grooves 9 as shown in FIG. 1. The double-layer film thus divided into parts serves as the metal electrodes 62, and the double-layer film on the end-face side to which the conductive layers 3*a* and 3*c* are laid bare serves as the metal electrode 61.

Then, the metal electrode 61 is earthed and also a high voltage is applied to all the metal electrodes 62. In other words, all the conductive layers 3*a* and 3*c* are earthed and also a high voltage is applied to all the conductive layers 3*b* and 3*d* to polarize the piezoelectric ceramic layers 2*a*, 2*b* and 2*c* in the directions of the arrows A, B and C, respectively.

To the actuator member 30 prepared in this way, the manifold member 17 is joined to the end face 30*b* as previously described, and to the upper surface 30*c* the flexible printed board 41 is joined. Thus, the ink-jet head 40 is produced.

In the process for manufacturing the ink-jet head 40 as described above, the multi-layered piezoelectric ceramic layers 2 of the actuator 4 are formed using the sol-gel solution, and hence the piezoelectric ceramic layers 2 can be formed in a small thickness. Hence, the drive voltage necessary for jetting the ink out of the ink chamber 1*a* can be set at a low value. It may be only several volts when three piezoelectric ceramic layers 2 of 15 $\mu$m thick are formed. Accordingly, the distance between the metal electrodes 62 connected to the contact point electrodes 43 of the flexible printed board 41 can be made shorter than ever. Thus, the ink-jet head 40 can be made smaller in size and the degree of integration of nozzles can be enhanced. Also, the drive circuits can be prepared at a low cost.

In addition, the inner surface of the ink chamber 1 is formed of the conductive layer 3*a* formed on the very smooth master 10. Hence, the inner surface of the ink chamber 1 is so smooth that there is no room for air stagnation, making it possible to achieve stable ink jetting.

Moreover, since the nozzle 9 and the ink chamber 1 can be formed at the same time, it is unnecessary to provide any nozzle plate having nozzles formed therein, which has been conventionally necessary. Hence, any devices and steps therefor are unnecessary, so that the production cost can be reduced.

Furthermore, since all the actuators 4 are integrally set up by the holder 5 made of resin, it is unnecessary to make registration of the respective actuators 4.

Still furthermore, the flexible printed board 41 connected to the LSI chip 51 and the metal electrodes 61 and 62 are connected on the upper surface 30*c* of the actuator member 30, they can be connected with ease.

In addition, in the process for manufacturing the present ink-jet head, the head is produced by a lithographic technique using the master. Hence, the disposition and shape of the ink chamber 1 may depend on the designing of the pattern 13*b* of the mask 13 used when the master 10 is prepared. The mask 12 is usually prepared by freely drawing a pattern with electron beams, and hence the disposition of ink chambers can be made at a very high degree of freedom. When viewed from the manufacturing process, the LIGA technique for preparing the master 10 is an extension of a semiconductor technique, and is advantageous for mass production. The plating and the vacuum deposition are also techniques having been already well established, promising a high yield. Also, the formation of the piezoelectric ceramic layers 2 by the use of the sol-gel solution enables mass production. Still also, the piezoelectric ceramic layers 2 can be formed in any desired thickness.

In the above first embodiment, the actuator member 30 and the manifold member 17 are separately made up, which, alternatively, be integrally formed. An example thereof will be described below with reference to the drawings, as a basic, second embodiment.

Figure 13:
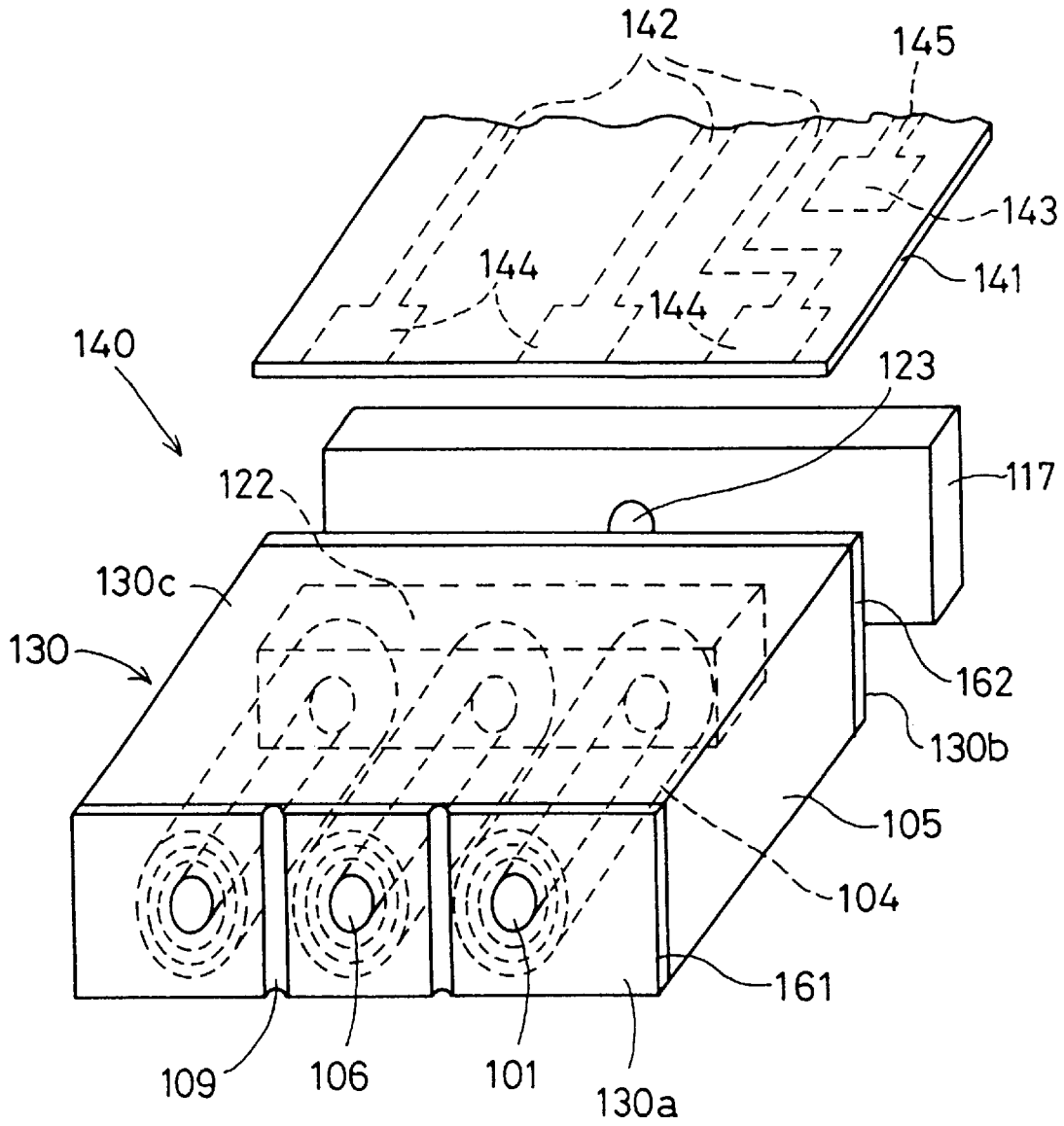
FIG. 13 is a perspective view to illustrate an ink-jet head according to a second embodiment of the present invention.

FIG. 13 perspectively illustrates the structure of such an ink-jet head. An ink-jet head 140 is constituted of an actuator member 130 and a flexible printed board 141. The actuator member 130 is comprised of a plurality of hollow cylindrical actuators 104, a holder 105 made of a resin, that holds the actuators 104, and a manifold 122 communicating with the hollow portion of each cylindrical actuator 104.

Figure 14:
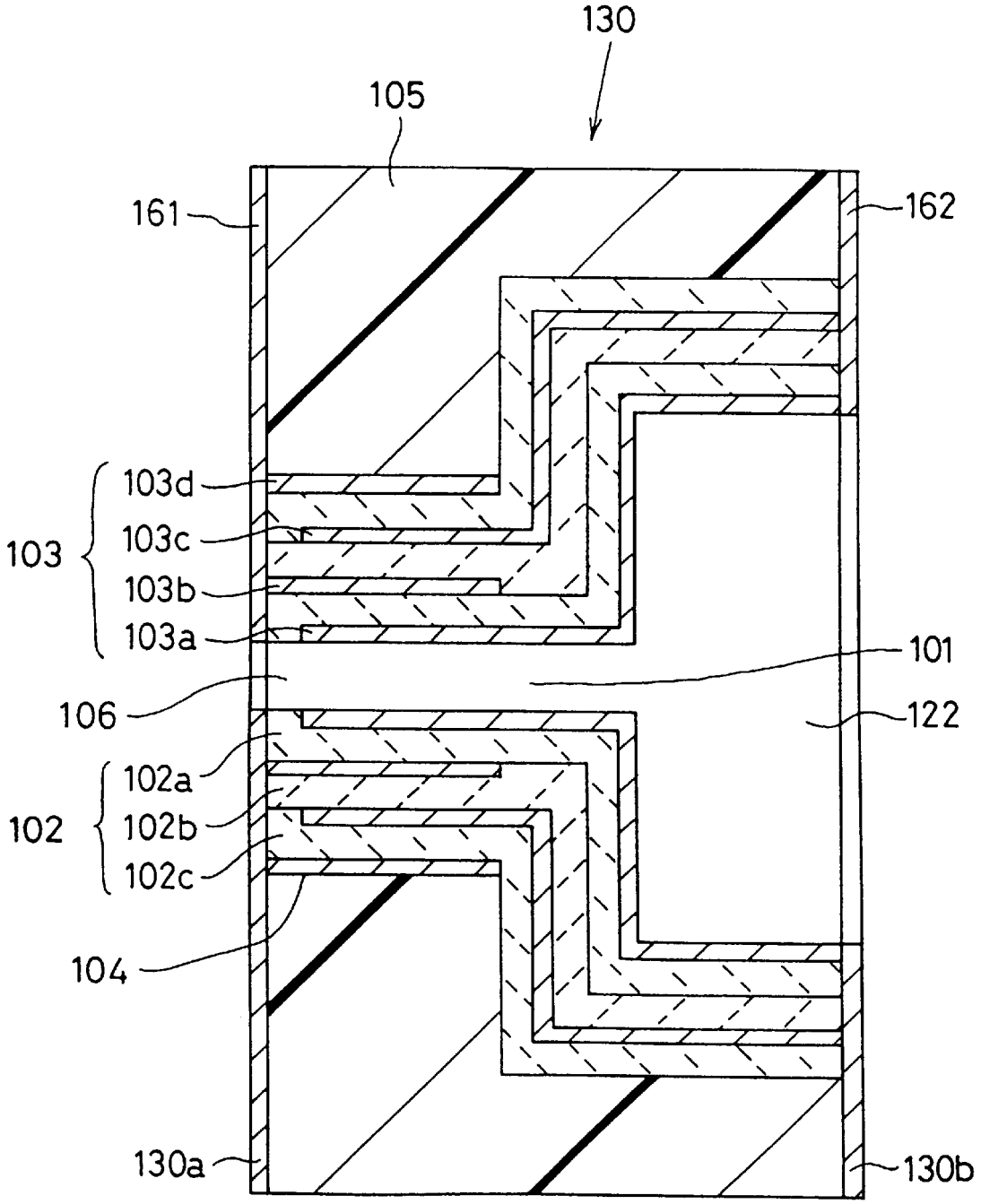
FIG. 14 is a cross-sectional view of an actuator member in the second embodiment.

As shown in FIG. 14, the actuator 104 is formed of conductive layers 103 and piezoelectric ceramic layers 102 which are alternately superposingly formed in plurality. In the second embodiment, the conductive layers 103 are superposed in four Layers, and the piezoelectric ceramic layers are superposed in three layers. A first hollow portion provided in plurality in a cylindrical form and a second hollow portion communicating with each of the first hollow portion are formed in the actuator 104.

A conductive layer 103*a* is formed on the inner surface of the piezoelectric ceramic layer 102*a* at its parts corresponding to the first hollow portion and second hollow portion, and a conductive layer 103*b* is formed on the outer surface thereof at its part corresponding to the first hollow portion. A piezoelectric ceramic layer 102*b* is formed on the outer surface of the conductive layer 103*b*, and a conductive layer 103*c* is formed on the outer surface of the piezoelectric ceramic layer 102*b* at its parts corresponding to the first hollow portion and second hollow portion. A piezoelectric ceramic layer 102*c* is formed on the outer surface of the conductive layer 103*c* at its parts corresponding to the first hollow portion and second hollow portion, and a conductive layer 103*d* is formed on the outer surface of the piezoelectric ceramic layer 102*c* at its part corresponding to the first hollow portion. The conductive layers 103*a* and 103*c* are laid bare on the side of a n end face 130*b* of the actuator member 130, and are not laid bare on the side of another end face 130*a* thereof. The conductive layers 103*b* and 103*d* are laid bare on the side of the end face 130*a*. and are not laid bare on the side of the end face 130*b*.

Thus, the conductive layers 103*a* and 103*c* are connected to a metal electrode 162 formed on the end face 130*b* of the actuator member 130, and the conductive layers 103*b* and 103*d* are connected to a metal electrode 161 formed on the end face 130*a*. The metal electrode 162 is connected in common to the conductive layers 103*a* and 103*c* of all the actuators 104, and each metal electrode 161 is separated by a groove 9. Hence, each metal electrode 161 is formed correspondingly to each actuator 104 and is connected to the conductive layers 103*b* and 103*d* of each actuator 104.

The piezoelectric ceramic layers 102*a*, 102*b* and 102*c* are polarized in the same directions as the directions A, B and C in which the piezoelectric ceramic layers 2*a*, 2*b* and 2*c* of the first embodiment are polarized as shown in FIG. 4. More specifically, the piezoelectric ceramic layer 102*a* is polarized in the direction of from the conductive layer 103*b* to the conductive layer 103*a*, the piezoelectric ceramic layer 102*b* is polarized in the direction of from the conductive layer 103*b* to the conductive layer 103*c*, and the piezoelectric ceramic layer 102*c* is polarized in the direction of from the conductive layer 103*d* to the conductive layer 103*c*.

The first hollow portion of the actuator 104 forms an ink chamber 101 to be filled with ink, and opens to the opposing end faces 130*a* and 130*b* of the actuator member 130. The opening on the side of the end face 130*a* forms a nozzle 106 out of which the ink is jetted. The second hollow portion of the actuator 104 forms the manifold 122.

As shown in FIG. 13, a cover member 117 is bonded to the end face 130 of the actuator member 130 so as to cover the manifold 122. The cover member 117 is provided with an ink feed inlet 123 communicating with an ink tank (not shown), and the ink is fed from the ink tank to the manifold 122 through the ink feed inlet 123.

The flexible printed board 141 is bonded to the surface 130*c* of the actuator member 130 (the upper surface as viewed in FIG. 13). On the flexible printed board 141, contact point electrodes 143 and 144 are formed. Each contact point electrode 144 is provided correspondingly to each metal electrode 161, and the contact point electrode 143 is provided correspondingly to the metal electrode 162. Each contact point electrode 144 is connected to each conductive line 142, and the contact point electrode 143 is connected to the conductive line 145.

Figure 15:
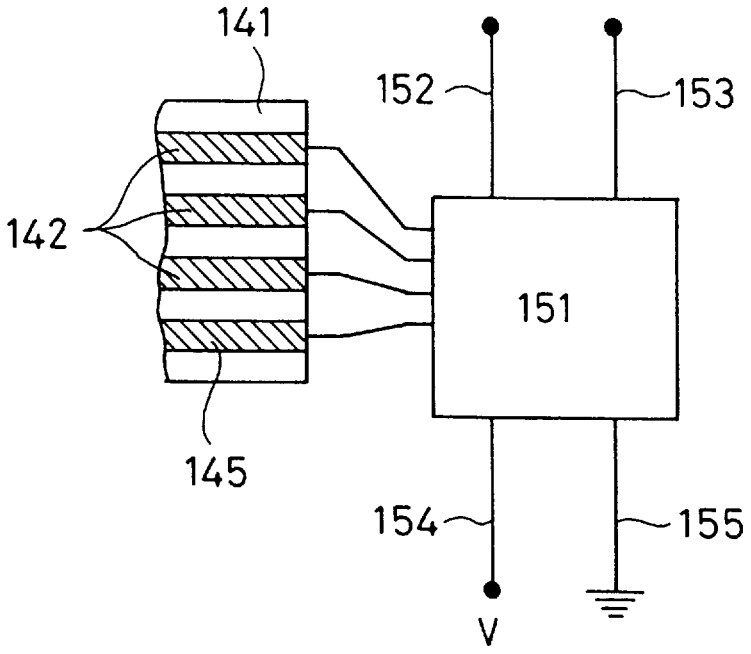
FIG. 15 is a block diagram to illustrate a control section in the second embodiment.

The respective conductive lines 142 and 145 are connected, as shown in FIG. 15, to an LSI chip 151. A clock line 152, a data line 153, a voltage line 154 and an earth line 155 are also connected to the LSI chip 151. The LSI chip 151 judges which nozzle 106 should jet out ink droplets first, judging from the data coming to pass on the data line 153 and in accordance with continuous clock pulses fed from the clock line 152, and applies a voltage V of the voltage line 154 to the conductive lines 142 electrically conducting to the metal electrode 162. The conductive line 142 electrically conducting to the metal electrode 161 other than that of the ink chamber 101 to be driven and the conductive line 145 electrically conducting to the metal electrode 162 are connected to the earth line 155.

This ink-jet head 140 is driven in the same manner as in the first embodiment, i.e., by deformation of the piezoelectric ceramic layers 102*a*, 102*b* and 102*c* at their parts corresponding to the ink chamber 101 (see FIGS. 4 and 5).

A process for manufacturing the ink-jet head 140 that characterizes the ink-jet device according to the second embodiment will be described below.

As the first step, in the same manner as in the first embodiment, a master 10 is prepared which is, as shown in FIG. 6, provided with a plurality of cylinders 21 upright arranged on a conductive substrate 11.

Figure 16A:
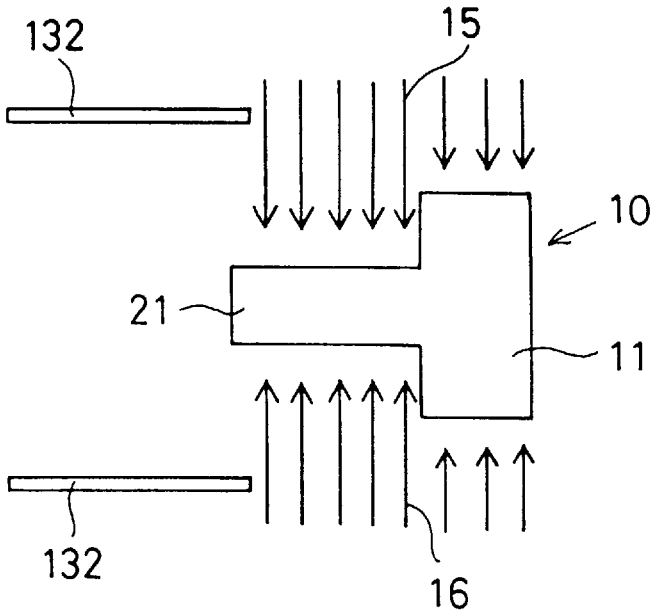
FIGS. 16A and 16B illustrate steps to form a conductive layer of the actuator member in the second embodiment.
Figure 17A:
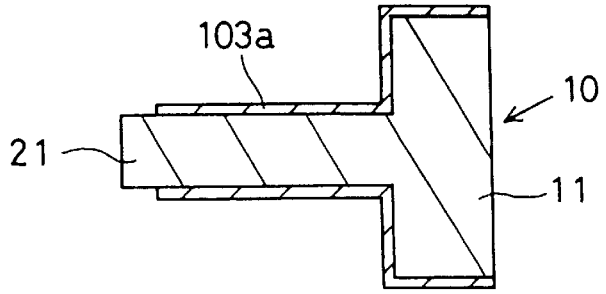
FIGS. 17A to 17D illustrate steps through which conductive layers and piezoelectric ceramic layers are superposingly formed in the second embodiment.

Subsequently, a conductive layer 103*a* of 1 μm thick made of titanium is formed on each cylinder 21 and conductive substrate 11 of the master 10. This layer is formed in the following way. As shown in FIG. 16A, a masking shield 132 is set to cover the portions corresponding to the top of the cylinder 21, and vacuum deposition is carried out from two directions (arrows 15 and 16) to form the conductive layer 103*a* on the cylinder 21 and conductive substrate 11 as shown in FIG. 17A.

Figure 17B:
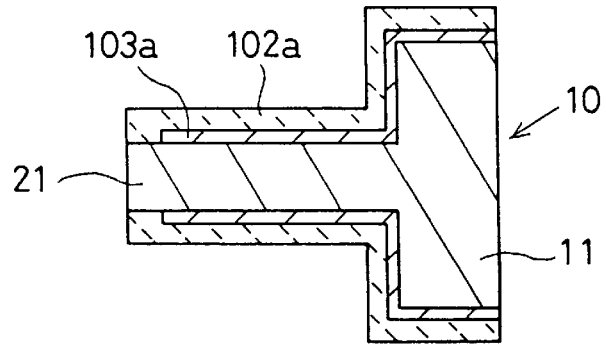

Next, as the second step, the piezoelectric ceramic layer 102*a* is formed on the cylinder 21 and conductive substrate 11 so as to cover the conductive layer 103*a*, as shown in FIG. 17B and in the same manner as in the first embodiment.

Figure 16B:
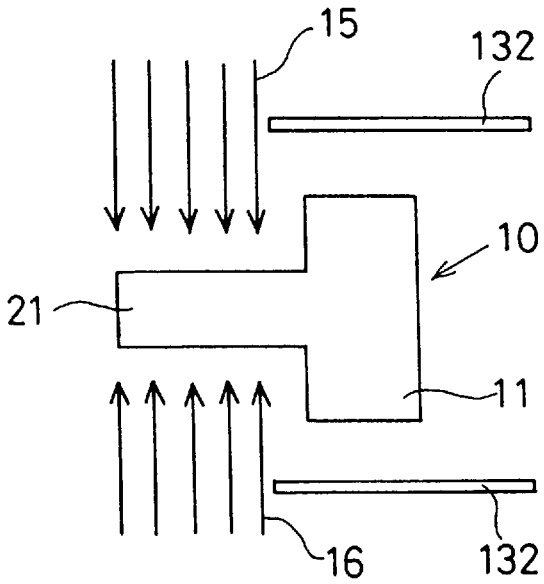
Figure 17C:
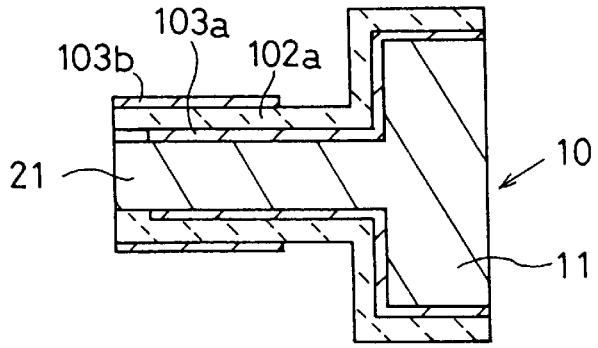

Next, as shown in FIG. 17C, a conductive layer 103*b* of 1 μm thick made of titanium is formed on the piezoelectric ceramic layer 102*a*. This layer is formed in the following way. As shown in FIG. 16B, a masking shield 132 is set to cover the portions corresponding to the base of the cylinder 21 and the conductive substrate 11, and vacuum deposition is carried out from two directions (arrows 15 and 16) to form the conductive layer 103*b*.

Figure 17D:
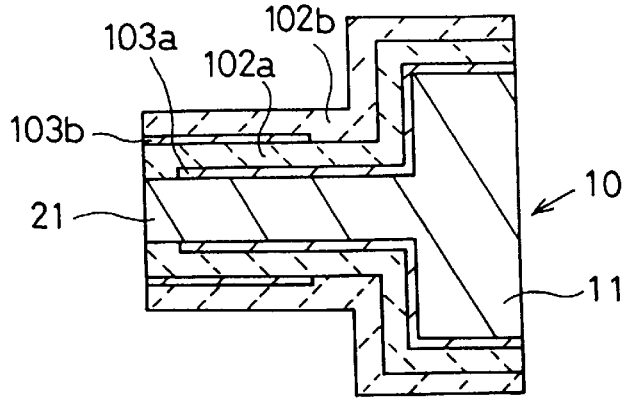

Next, as shown in FIG. 17D, the piezoelectric ceramic layer 102*b* is formed in the same manner as the piezoelectric ceramic layer 102*a*. Subsequently, a conductive layer 103*c* of 1 μm thick made of titanium is formed on the piezoelectric ceramic layer 102*b* in the same manner as the conductive layer 103*a*, and the piezoelectric ceramic layer 102*c* is further formed thereon in the same manner as the piezoelectric ceramic layer 102*a*. Next, on the piezoelectric ceramic layer 102*c*, a conductive layer 103*d* of 1 μm thick made of titanium is formed in the same manner as the conductive layer 103*b*.

Figure 18:
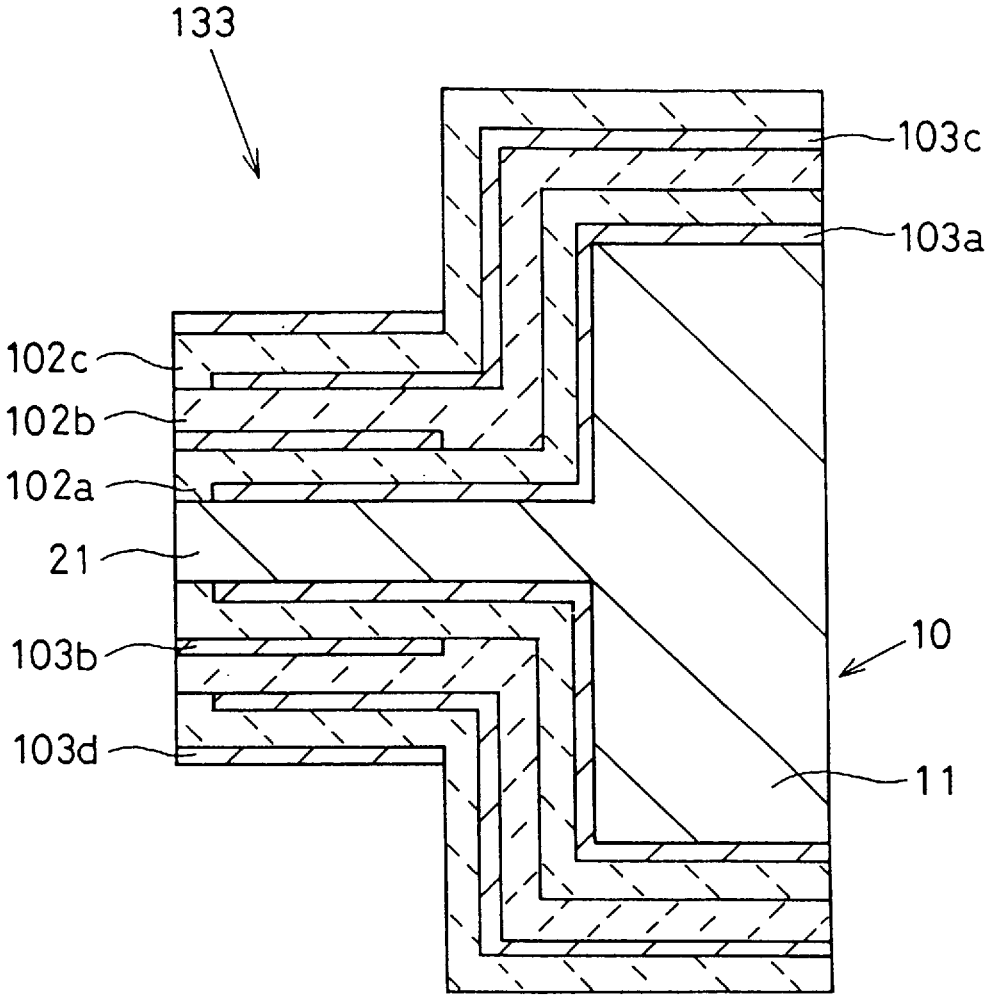
FIG. 18 is a cross-sectional view to illustrate a PZT structure in the second embodiment.

The master 10 on which the conductive layers 103*a*, 103*b*, 103*c* and 103*d* and the piezoelectric ceramic layers 102*a*, 102*b* and 102*c* have been formed in this way is fired at about 600° C. for about 30 minutes to form the piezoelectric ceramic layers 102, having good piezoelectric properties. Thus, a PZT structure 133 (FIG. 18) having a multi-layered cylinder is prepared.

Figure 19:
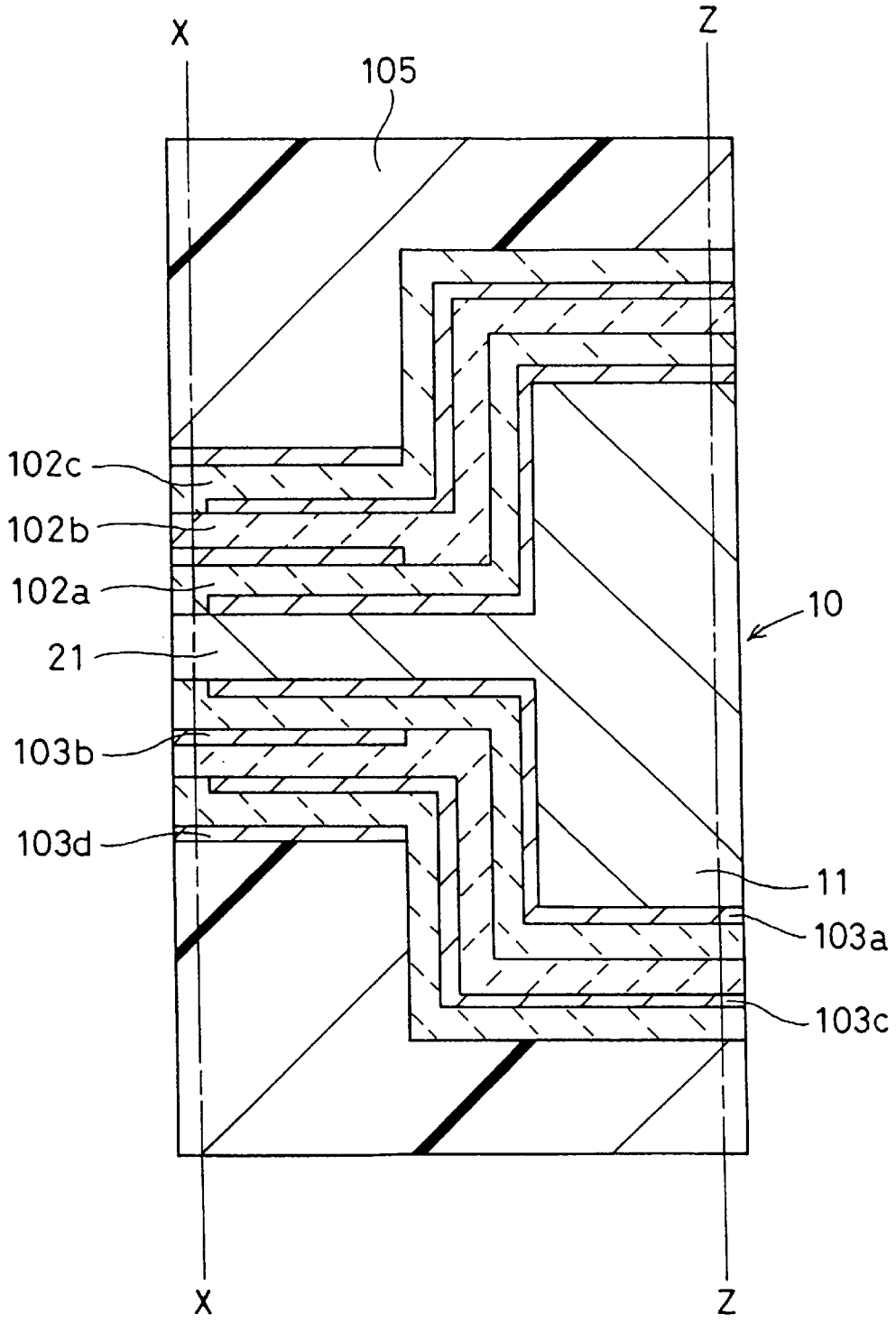
FIG. 19 illustrates a step to produce the actuator member in the second embodiment.

Next, as the third step, a plurality of multi-layered cylinders are covered with a resin of an epoxy type or the like to integrally form the PZT structure into a block (FIG. 19). The resin serves as the holder 105. Then, the cylinder 21 is cut on the side of its top along the line X—X, and also cut on the side of its conductive substrate 11 along the line Z—Z. The conductive layers 103*b* and 103*d* are laid bare to the X—X line cut surface, and the conductive layers 103*a* and 103*c* are laid bare to the Z—Z line cut surface.

Figure 20:
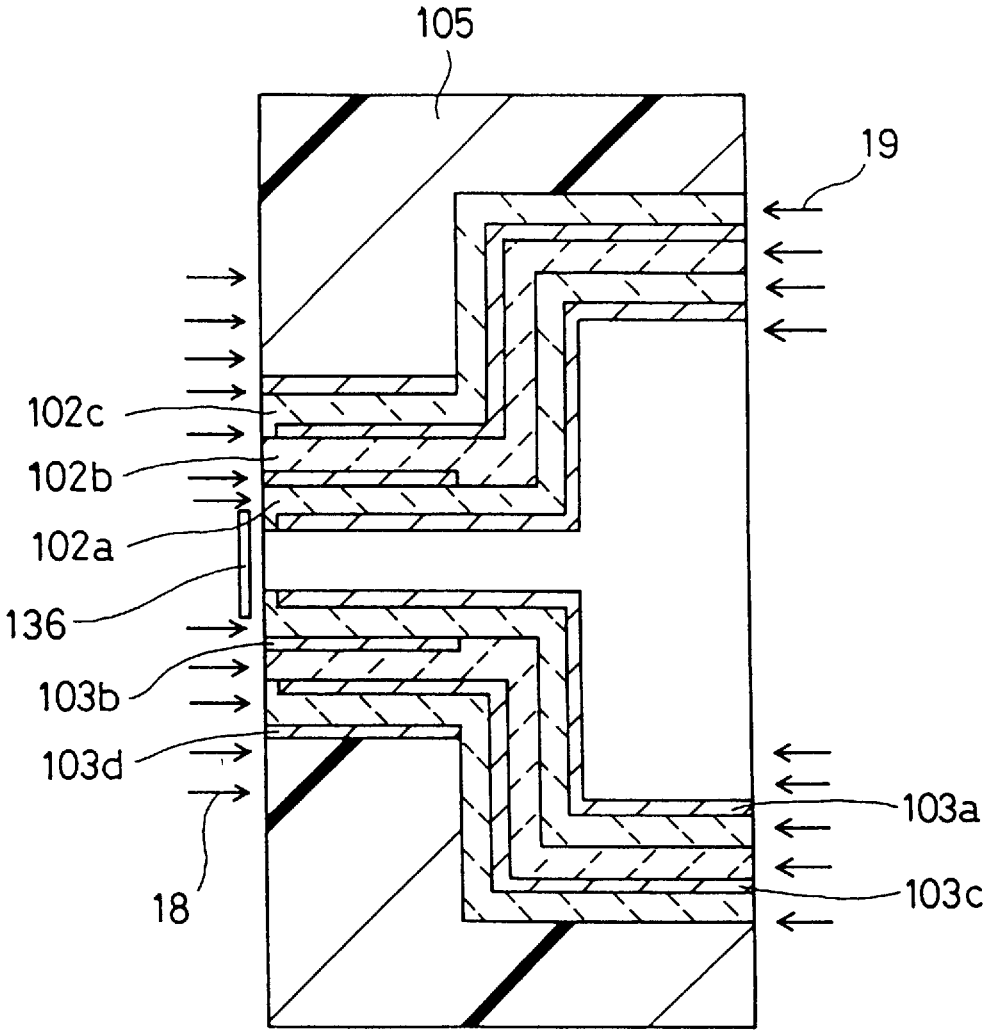
FIG. 20 illustrates a step to form metal electrodes at end faces of the actuator member in the second embodiment.
Figure 21:
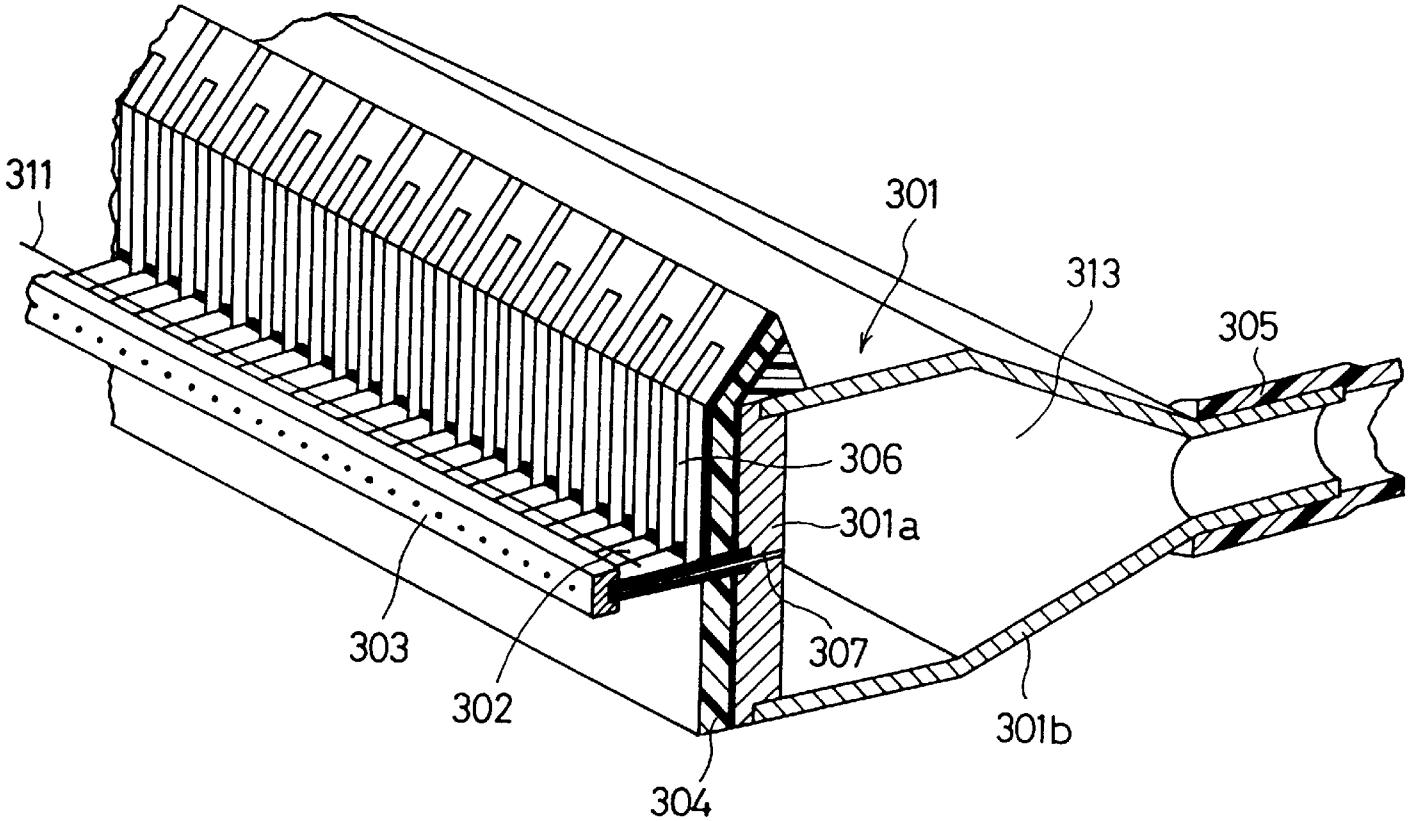
PRIOR ART Fig. 21
FIG. 21 is a perspective view to illustrate a ink-jet head of the prior art.

Next, as the fourth step, the master 10 made of nickel is dissolved away by wet etching with a ferric chloride solution. As a result, the part corresponding to each cylinder 21 and conductive substrate 11 becomes hollow. Then, as shown in FIG. 20, a chromium-nickel double-layer film is first formed on the whole end face to which the conductive layers 103*a* and 103*c* are laid bare, the film being formed by vacuum deposition applied from the side of arrows 19. Next, another chromium-nickel double-layer film is formed on the whole end face to which the conductive layers 103*b* and 103*d* are laid bare, the film being formed by vacuum deposition applied from the side of arrows 18. Here, in order to prevent a short between i) the conductive layer 103*a* and the chromium-nickel double-layer film formed on the side to which the conductive layers 103*a* is laid bare and ii) the chromium-nickel double-layer film formed on the side to which the conductive layer 103*b* is laid bare, a masking shield 136 which is slightly larger than the diameter of the ink chamber 101 and slightly smaller than the diameter of a circle formed by the conductive layer 103*b* (the distance between the upper conductive layer 103*b* and the lower conductive layer 103*b* as cross-sectionally viewed in FIG. 20) is provided in the positional relation as shown in FIG. 20, to carry out the vacuum deposition from the side of arrows 18. Thus, the double-layer film formed on the side to which the conductive layer 103*b* is laid bare can be prevented from extending into the ink chamber 101. Thereafter, the double-layer film on the side to which the conductive layers 103*b* and 103*d* are laid bare is mechanically divided by means of a diamond blade to form the grooves 9 as shown in FIG. 13. The double-layer film thus divided into parts serves as the metal electrodes 161, and the double-layer film on the end-face side to which the conductive layers 103*a* and 103*c* are laid bare serves as the metal electrode 162.

Then, the metal electrode 162 is earthed and also a high voltage is applied to all the metal electrodes 161. In other words, all the conductive layers 103*a* and 103*c* are earthed and also a high voltage is applied to all the conductive layers 103*b* and 103*d* to polarize the piezoelectric ceramic layers 102*a*, 102*b* and 102*c*.

To the actuator member 130 prepared in this way, the cover member 117 is joined to the end face 130*b* as previously described, and to the upper surface 130*c* the flexible printed board 141 is joined. Thus, the ink-jet head 140 is produced.

The process for manufacturing the ink-jet head 40 that characterizes the ink-jet device according to the second embodiment as described above can also be similarly effective as in the first embodiment. In addition, the manifold 122 and the ink chamber 101 can be simultaneously formed, and hence there is no bonded joint between the manifold 122 and the ink chamber 101. Hence, the registration between the manifold 122 and the ink chamber 101 can be made with ease, and no ink leakage may occur between the manifold 122 and the ink chamber 101.

In the first and second embodiments described above, the actuator 4 or 104 has the shape of a cylinder, which cylinder, however, may be not circular but polygonal.

In the first and second embodiments described above, the open ends of the ink chambers 1 or 101 form the nozzles 6 or 106. Alternatively, a nozzle plate with a plurality of nozzles formed therein may be joined to the open ends. The nozzle plate may also be a nozzle plate in which one nozzle communicates with a plurality of ink chambers, e.g., two ink chambers.

In the first and second embodiments described above, the ink chamber 1 or 101 has the shape of a column, which alternatively may have the shape of a funnel, or may be tapered, at its part forming the nozzle.

In the first and second embodiments described above, when the conductive layers 3 or 103 are formed, the vacuum deposition is carried out from two directions, which vacuum deposition may also be carried out from three or more directions. Alternatively, the vacuum deposition may be carried out from one direction and the master may be turned over so that the conductive layer can be formed at the desired position.

In the first and second embodiments described above, three piezoelectric ceramic layers 2 or 102 are superposingly formed, but there are no particular limitations on the number of the piezoelectric ceramic layers 2 or 102.

In the first and second embodiments described above, the master 10 is made of nickel, which alternatively be made of chromium.

In the first and second embodiments described above, the metal electrode 61 or 162 which is common to all the ink chambers 1 or 102 are earthed, and either a voltage is applied to the metal electrode 62 or 161 corresponding to each ink chamber 1 or 101, or the electrode is earthed, to thereby control whether or not the ink be jetted. Alternatively, changing the structure of the LSI chip, a voltage may be applied to the metal electrode 61 or 162, and either the metal electrode 62 or 161 may be earthed or brought into a high impedance, to thereby control whether or not the ink be jetted.

In the second embodiment described above, the actuator member 130 and the cover member 117 having the ink feed inlet 123 are provided as separate members. Alternatively, the ink feed inlet 123 may be integrally provided in the actuator member 130, whereby the cover member 117 becomes unnecessary to bring about a cost reduction.

As is clear from what has been described above, according to the ink-jet device of the present invention, the actuator comprises the electrodes and piezoelectric ceramic layers which are alternately formed layer by layer in a cylindrical form so as to provide a hollow portion at the actuator center, and hence the actuator can be highly rigid. Hence, the drive voltage necessary for jetting the ink out of the ink chamber 1*a* can be set at a low value. Accordingly, the distance between the electrodes at their portions connected to the power source circuit can be made shorter than ever. Thus, the ink-jet device can be made smaller in size and the degree of integration of nozzles can be enhanced. Also, the drive circuits can be prepared at a low cost.

According to the process for manufacturing the ink-jet device of the present invention, in the second step, the piezoelectric ceramic layers are formed at least on the cylindrical portion of the master by the use of the sol-gel solution of a piezoelectric material, and hence the piezoelectric ceramic layers can be formed in a small thickness. Hence, the drive voltage necessary for jetting the ink out of the ink chamber can be set at a low value. Accordingly, the distance between the electrodes at their portions connected to the power source circuit can be made shorter than ever. Thus, the ink-jet device can be made smaller in size and the degree of integration of nozzles can be enhanced. Also, the drive circuits can be prepared at a low cost.

In the third step, a plurality of cylindrical portions of the piezoelectric ceramic layers are integrally formed, and in the fourth step the master is dissolved, so that hollow portions are made at the parts corresponding to the cylindrical portions of the master, and thus the ink chambers are formed. At the same time, a plurality of actuators having the piezoelectric ceramic layers are produced. Hence, a plurality of actuators having the ink chambers are integrally produced. Thus, no registration is required for the individual actuators, making their manufacture easy.

The master may also be formed in any desired shapes, whereby the flow path through which the ink flows can be of any shape that may allow the ink to flow with ease. Hence, it is possible to manufacture ink-jet devices that can be free from air trapping.

Figure 22:
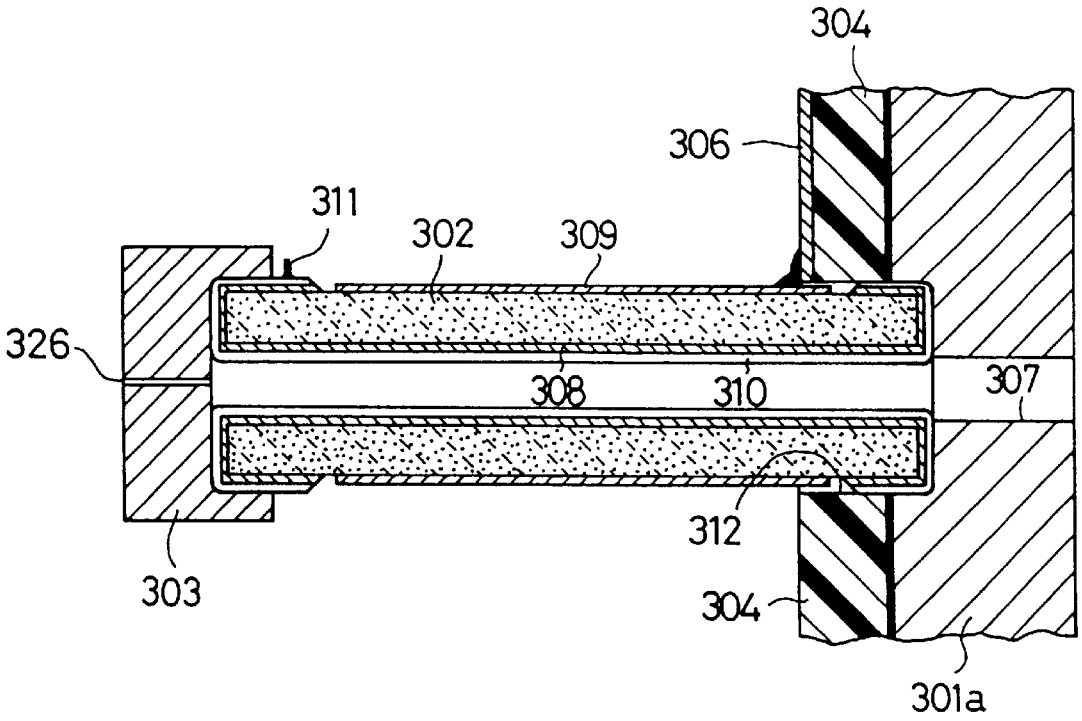
Fig. 22 PRIOR ART
FIG. 22 is a cross-sectional view to illustrate the ink-jet head of the prior art.

The manufacturing process of the present invention is particularly preferable as a process for manufacturing the ink-jet device of the present invention, having the piezoelectric ceramic layers and conductive layers which are alternately formed layer by layer. This process can also be preferably applied to the case when the ink-jet device having a single-layer piezoelectric ceramic layer as shown in FIG. 22 is manufactured. Thus, such an embodiment is also embraced in the manufacturing process of the present invention.

What is claimed is:

1. An ink-jet device comprising at least one ink chamber that feeds ink from an ink feed source, at least one actuator that changes the volume of the ink chamber to cause the ink to jet out of the ink chamber, and electrodes to which a voltage is applied from a power source circuit, wherein said actuator comprises a plurality of piezoelectric ceramic layers and said electrodes; said plurality of piezoelectric ceramic layers and said electrodes are alternately formed layer by layer in a cylindrical or polygonal form so as to provide a hollow portion at the actuator center; and said hollow portion corresponds to said ink chamber.

2. The ink-jet device according to claim 1, wherein all of said actuators are integrally held by a holder.

3. The ink-jet device according to claim 2, wherein said holder comprises a material having a Rockwell hardness of from M-60 to M-130.

4. The ink-jet device according to claim 1, wherein said electrodes are comprised of a first electrode earthed through said power source circuit and a second electrode to which a voltage is applied from said power source circuit; said first electrode being formed on the inner surface of said ink chamber.

5. The ink-jet device according to claim 4, wherein said first electrodes of all actuators are connected to a common electrode at one part of the outer surface of the actuators integrally held, and said second electrode of each actuator is connected to a corresponding drive electrode at the other part other than the one part of the outer surface of the actuator integrally held; said common electrode and said drive electrode being connected to said power source circuit.

6. The ink-jet device according to claim 5, wherein said one part of the actuator at which said common electrode is formed is one end of said actuator integrally held, and the other part of the actuator at which said drive electrode is formed is the other end of said actuator integrally held.

7. The ink-jet device according to claim 1, wherein at least one nozzle out of which the ink is jetted is integrally formed in said actuator.

8. The ink-jet device according to claim 7, wherein said nozzle has a shape different from that of said hollow portion of said actuator.

9. The ink-jet device according to claim 1, wherein a manifold communicating with each ink chamber is integrally formed with said actuator.

10. A process for manufacturing an ink-jet device comprising at least one ink chamber that feeds ink from an ink feed source, and at least one actuator that changes the volume of the ink chamber to cause the ink to jet out of the ink chamber; said process comprising:

first step of preparing a master having at least one cylindrical or polygonal portion;

the second step of bringing at least the cylindrical or polygonal portion of said master into contact with a sol-gel solution of a piezoelectric ceramic material to form a piezoelectric ceramic layer thereon;

the third step of bringing the cylindrical or polygonal portion of said piezoelectric ceramic layer into an integral form; and the fourth step of removing said master so as to provide a hollow portion at the part corresponding to the cylindrical or polygonal portion of said master to form said ink chamber and at the same time produce said actuator; said actuator comprising the piezoelectric ceramic layer.

11. The process for manufacturing an ink-jet device according to claim 10, wherein the ink-jet device has a manifold communicating with each ink chamber and to which the ink is fed from the ink feed source;

said first step being the step of preparing a master having at least one cylindrical or polygonal portion and a support that supports the cylindrical or polygonal portion;

said second step being the step of forming said piezoelectric ceramic layer on the cylindrical or polygonal portion and support of said master; and said fourth step being the step of removing said master so as to provide a hollow portion at the part corresponding to the cylindrical or polygonal portion and support of said master to form said ink chamber and said manifold and at the same time produce said actuator; said actuator comprising the piezoelectric ceramic layer.

12. The process for manufacturing an ink-jet device according to claim 10, wherein:

between said first step and said second step, a conductive layer is formed on at least the cylindrical or polygonal portion of said master;

between said second step and said third step, a conductive layer is formed on said piezoelectric ceramic layer; and said fourth step being the step of removing said master so as to provide a hollow portion at the part corresponding to the cylindrical or polygonal portion of said master to form said ink chamber and at the same time produce said actuator; said actuator comprising the conductive layer and the piezoelectric ceramic layer.

13. The process for manufacturing an ink-jet device according to claim 12, having the step of superposingly forming said piezoelectric ceramic layer and said conductive layer each in plurality.

14. The process for manufacturing an ink-jet device according to claim 12, wherein;

said conductive layer formed in a step between said first step and said second step is laid bare to one part of the outer surface of said actuator integrally formed; and said conductive layer formed in a step between said second step and said third step is laid bare to the other part of the outer surface of said actuator integrally held;

a common electrode to which the conductive layers of all actuators are connected being formed at said one part or the other part of said actuator; and a drive electrode being formed at the other part or one part of said actuator, correspondingly to each actuator.

15. The process for manufacturing an ink-jet device according to claim 14, wherein said one part of the outer surface of said actuator integrally held is one end face of said actuator integrally held, and the other part of said actuator integrally held is the other end face of said actuator integrally held.

16. The process for manufacturing an ink-jet device according to claim 10, wherein in said third step said cylindrical or polygonal portion of said piezoelectric ceramic layer is brought into an integral form by the use of a material having a Rockwell hardness of from M-60 to M-130.

17. The process for manufacturing an ink-jet device according to claim 10, wherein a portion corresponding to a nozzle for jetting the ink is formed in one part of said master; said nozzle being integrally formed in said actuator.

18. The process for manufacturing an ink-jet device according to claim 17, wherein said portion corresponding to the nozzle for jetting the ink has a shape different from that of said cylindrical or polygonal portion.

* * * * *